United States Patent [19]

Ichinose et al.

[11] 3,991,340

[45] Nov. 9, 1976

[54] DISCHARGE LAMP LIGHTING APPARATUS INCLUDING A SINTERED TYPE OXIDE NEGATIVE RESISTANCE STARTING ELEMENT

[75] Inventors: Noboru Ichinose, Yokohama; Yuhji Yokomizo, Tokyo; Masaki Katsura, Mitaka; Suezo Sugaike, Tokyo, all of Japan

[73] Assignee: Tokyo Shibaura Electric Co., Ltd., Kawasaki, Japan

[22] Filed: Aug. 14, 1974

[21] Appl. No.: 497,514

[30] Foreign Application Priority Data

Aug. 20, 1973 Japan ..... 48-92385

[52] U.S. Cl. ..... 315/106; 315/99; 315/101; 315/DIG. 5; 338/20

[51] Int. Cl.[2] ..... H05B 41/04

[58] Field of Search ..... 315/98, 100, 101, DIG. 2, 315/DIG. 5, 99, 106, 107; 338/20, 21; 307/324; 252/518, 521; 317/50, 67

[56] References Cited

UNITED STATES PATENTS 3,760,224 9/1973 Shimizu et al. ..... 315/101 X 3,836,483 9/1974 Ichinose et al. ..... 338/21 X

FOREIGN PATENTS OR APPLICATIONS 679,857 9/1952 United Kingdom ..... 315/DIG. 2

1,072,717 6/1967 United Kingdom ..... 315/DIG. 2

*Primary Examiner*—Eugene La Roche

*Attorney, Agent, or Firm*—Cushman, Darby & Cushman

[57] ABSTRACT

A discharge lamp (e.g., fluorescent lamp) lighting apparatus using as the starting element a sintered type oxide resistance element having the voltage-current characteristic that the element is rendered conductive when impressed with an inter-electrode voltage applied at the discharge lamp starting time and rendered substantially non-conductive while impressed with an inter-electrode voltage applied during lighting of the discharge lamp. The discharge lamp lighting apparatus using in particular a sintered type oxide resistance element comprising ZnO, MgO and $MnO_2$ as the starting element presents an excellent performance.

5 Claims, 3 Drawing Figures

DISCHARGE LAMP LIGHTING APPARATUS INCLUDING A SINTERED TYPE OXIDE NEGATIVE RESISTANCE STARTING ELEMENT

This invention relates to a discharge lamp lighting apparatus, and more particularly to a discharge lamp lighting apparatus wherein start-lighting is always quickly and reliably effected.

In the prior art, lighting apparatus using a starter lamp based on the utilization of glow discharge is used with a discharge lamp such as a fluorescent lamp. However, the lighting apparatus using such starter lamp has the drawback that as large a length of time as 2 to 3 seconds is required until the lamp is lit after powered. The reasons are as follows. When the discharge tube is powered, the starter lamp makes a glow discharge to cause a bimetal electrode to be expanded due to the resulting heat, thereby permitting a closure of the electrode preheating circuit of the discharge lamp, so that a preheating current flows across the paired electrodes of the discharge lamp. Subsequently, when the bimetal electrode is cooled to open the preheating circuit, a kick voltage is produced in the stabilizer (choking coil) in the lighting circuit which is then impressed upon the electrodes of the discharge lamp to commence its discharging, thereby lighting it. For the foregoing reasons, 2 to 3 seconds are required until the lamp is lit after the power source is closed. Further, the aforesaid starter lamp has the problem of being blackened due to the glow discharge after being used for a relatively small length of time thereby rendering it difficult to satisfactorily perform the discharge-starting and lighting functions.

A discharge lamp lighting apparatus using a thyristor in replacement of the foregoing starter lamp is also used. Such discharge lamp lighting apparatus eliminates the necessity of preheating the starting element (i.e., thyristor), so that start-lighting is quickly effected. Further, such apparatus adopts no mechanical contact mechanism, so that it must continue, as a principal, to perform the prescribed function over a long length of time. As well known, however, a thyristor has the shortcomings that it is easily affected by temperature or humidity, subject to aging with time, and lack of stability. Particularly where the discharge lamp itself begins to terminate its life and present difficulty in being lit, a preheating current undesirably flows in the thyristor for a considerably large length of time to cause a thermal breakdown of the thyristor, or to cause excessive heat and resulting breakage of the filament of the discharge electrode. As above described, the actual circumstance is that difficulties are encountered in putting to practical use the discharge lamp lighting apparatus using such thyristor as the discharge-starting element.

The object of the invention is to provide a discharge lamp lighting apparatus excellent in stability which is capable of always carrying out a quick and reliable startlighting operation and semipermanently performing this function.

A first characterizing feature of the invention resides in that the above object has been attained by using as the starting element a sintered type oxide resistance element having the voltage-current characteristic that the element is rendered conductive when impressed with an inter-electrode voltage applied at the discharge tube starting time and rendered substantially nonconductive when impressed with an inter-electrode voltage applied during the lighting operation.

A second feature of the invention resides in that this object has been attained by using as the starting element a sintered type oxide resistance element comprising about 60 to 90 mol%, or preferably 70 to 74 mol% of ZnO, 10 to 40 mol%, or preferably 16 to 20 mol% of MgO and 0.1 to 20 mol%, or preferably 8 to 12 mol% of $MnO_2$.

A third feature of the invention resides in that the start-lighting operation of the discharge lamp lighting apparatus is more stably and reliably carried out by incorporation of a diode in the discharge lamp lighting circuit.

This invention can be more fully understood from the following detailed description when taken in conjunction with the accompanying drawings, in which.

A discharge lamp lighting apparatus according to an embodiment of the invention will hereinafter be described by reference to the appended drawings.

Figure 1:
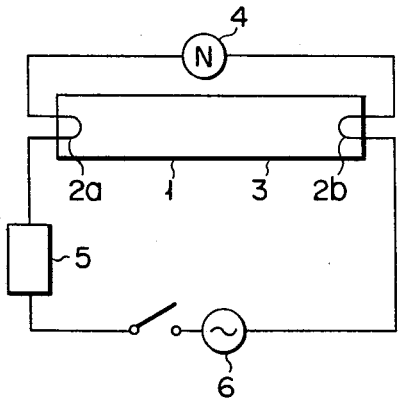
FIG. 1 is a block circuit diagram of a discharge lamp lighting apparatus of the invention.
Figure 2:
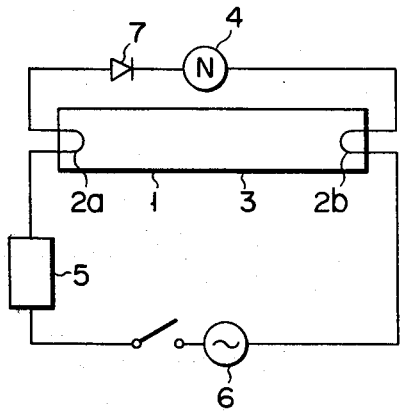
FIG. 2 is a block circuit diagram of the discharge lamp lighting apparatus of the invention having a diode in its circuitry.
Figure 3:
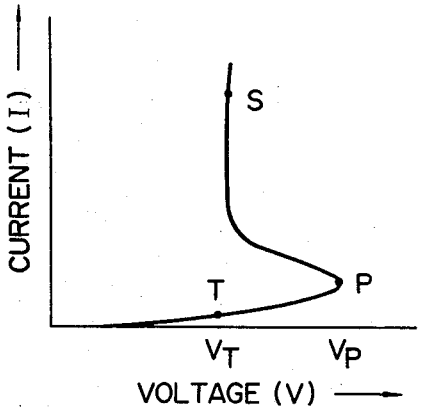
FIG. 3 is a curve diagram showing an example of the current-voltage characteristic of a sintered type oxide negative resistance element used as the starting element in the discharge lamp lighting apparatus of the invention.

As shown in FIG. 1, the discharge lamp lighting apparatus of the invention includes a fluorescent lamp 3 having a pair of hot cathodes 2*a* and 2*b* disposed within a tube 1 in a manner facing each other, a sintered type oxide resistance element 4 connected between the respective one side-ends of the hot cathodes 2*a* and 2*b*, a choking coil 5 connected to the other end of one hot cathode 2*a* of said paired hot cathodes, and a power source connected between the other end of the other hot cathode 2*b* of the paired hot cathodes and the choking coil 5. In this case, the foregoing sintered type oxide resistance element 4 has the current-voltage characteristic that it presents a conductivity sufficient to heat the hot cathodes 2*a* and 2*b* when impressed with a voltage applied between the hot cathodes 2*a* and 2*b* at the time of starting the fluorescent lamp 3, and presents a substantial nonconductivity when impressed with a voltage applied between both hot cathodes 2*a* and 2*b* during lighting of the fluorescent lamp. For example, such sintered type oxide resistance element 4 has such a current-voltage characteristic as is shown in FIG. 3, that is, a negative characteristic. In FIG. 3, S represents the point at which the resistance element 4 is in a conductive state, T the point at which the element 4 is in a nonconductive state, $V_T$ the voltage level in its nonconductive state, P the break-over point, and $V_P$ the break-over voltage. Further, as shown in FIG. 2, connection of a diode 7 between the resistance element and the fluorescent lamp enables the present discharge lamp lighting apparatus to start its operation with higher reliability. The diode used in this case may be a usual one.

The sintered type oxide resistance element of the invention is one comprising about 60 to 90 mol%, or preferably 70 to 74 mol% of ZnO, 10 to 40 mol%, or preferably 16 to 20 mol% of MgO, and 0.1 to 20 mol%, or preferably 8 to 12 mol% of $MnO_2$, and presents a particularly excellent characteristic as the starting element. The process of manufacturing this oxide resistance element is carried out as follows.

The respective raw material powders of ZnO, MgO and $MnO_2$ in the foregoing proportion range are weighed out so that, for example, ZnO, MgO and $MnO_2$ are 72 mol%, 18 mol% and 10 mol%, respectively, and are mixed with each other by, for example, a ball mill. After this mixture is presintered at approximately 800° C, the presintered mass is ground to obtain a fine powder. A binder such as polyvinyl alcohol is added to the powder and the resulting mass is molded into a disc-shaped plate approximately 6 to 10 mm in diameter and approximately 0.5 to 1 mm in thickness. This molding is sintered for approximately 2 hours at a temperature of 1200° to 1400° C, and a silver electrode is baked onto both surfaces of the resulting sintered mass, thereby to obtain a resistance element.

The operation of a fluorescent lamp lighting apparatus using this resistance element as a starting element will hereinafter be described.

First, when a power source voltage is impressed upon the resistance element 4 by connecting the power source 6 to the input terminal of the fluorescent lamp 3, it exceeds the break-over voltage $V_P$ of the resistance element to render the resistance element 4 conductive. Namely, closure of the power source instantaneously renders this resistance element 4 conductive, so that a current flows in the filament of the hot cathodes 2*a* and 2*b* of the fluorescent lamp 3 to cause the respective hot cathodes to be preheated. When this preheating is effected for about 30 milliseconds, the fluorescent lamp 3 is brought to a readily discharged state to easily and quickly perform the start-lighting operation by a voltage applied between the hot cathodes 2*a* and 2*b*. When, as above described, the fluorescent lamp 3 commences its lighting operation, the lighting voltage thereof is decreased to a level equal to approximately ⅔ the power source voltage. Accordingly, a voltage applied to the resistance element 4 is also decreased to render the same substantially nonconductive. That is, once the fluorescent lamp is lit, the resistance element is rendered nonconductive by being impressed with the decreased voltage.

Once lighting of the fluorescent lamp has been effected, the foregoing operation is not repeatedly carried out, so that the fluorescent lamp continues to be lit in a stable condition.

Where the fluorescent lamp fails to be start-lit, the foregoing operation is automatically repeated. In any case, upon closure of the power source, the fluorescent lamp 3 is start-lit quickly and reliably. Namely, in the discharge lamp lighting apparatus of the invention, the length of time required from the source closure to the lamp lighting is less than one second, which is equal to ½ to ⅓ that required in the case of a lighting apparatus using the prior art starter lamp.

Furthermore, the sintered type oxide resistance element used in the present lighting apparatus as the starting element is one obtained simply by sintering the oxides, so that it is easy to manufacture, low in manufacturing cost and extremely excellent in aging or temperature characteristic, and further semi-permanently performs a prescribed function without being subjected to thermal breakdown due to the action of a preheating current.

As above described, the fluorescent lamp lighting apparatus of the invention has many advantages due to the starting element being solid, small-sized and light, such as those of being made simple in construction, capable of effecting a quick and reliable start-lighting or good in stability to cause no deterioration of the start-lighting function, so that it can sufficiently serve the purpose when put to practical application.

The preceding description referred to the case where the discharge lamp was a fluorescent lamp, but this invention is also applicable to any other discharge lamp having a pair of discharge electrodes received in the tube and using as a light source the light produced due to the discharge between these electrodes. Further, in the preceding description, an example of the proportion of ZnO—MgO—$MnO_2$ series was shown as constituting the sintered type oxide resistance element. But, as previously mentioned, the present resistance element comprising 60 to 90 mol%, or preferably 70 to 74 mol% of ZnO, 10 to 40 mol%, or preferably 16 to 20 mol% of MgO and 0.1 to 20 mol%, or preferably 8 to 12 mol% of $MnO_2$ is particularly suitable.

Sintered type oxide resistance elements made from $Y_3Fe_{5-2x}Fe_xSi_xO_{12}$ series (x=1, 2, . . . ), $TiO_2$—$YFeO_3$ series, $Fe_2O_3$—CuO series, or NiO—$MnO_2$ series can also be used in the lighting apparatus according to the invention. These resistance elements, however, have to be selectively used in accordance with the type of discharge lamps and the level of voltage used. For example, the element whose break-over voltage is lower in level than the source voltage or the element which presents a negative characteristic when impressed with a voltage higher in level than that applied to the discharge electrode of a discharge lamp during lighting should selectively be used.

What we claim is:

1. A fluorescent lamp lighting apparatus comprising a fluorescent lamp having a pair of hot cathodes within its tube, a sintered type oxide negative resistance starting element connected between the respective one side-ends of said both hot cathodes, a choking coil connected to the other end of one of said pair of hot cathodes, and a power source connected between the other end of the other of said pair of hot cathodes and the choking coil, said starting element comprising about 60 to 90 mol percent ZnO, 10 to 40 mol percent MgO, and 0.1 to 20 mol percent $MnO_2$.

2. A fluorescent lamp lighting apparatus according to claim 1 wherein said element comprises 70 to 74 mol% of ZnO, 16 to 20 mol% of MgO and 8 to 12 mol% of $MnO_2$.

3. A fluorescent lamp lighting apparatus according to claim 1 comprising a diode connected between one side end of one of said paired hot cathodes and one end of said element.

4. A discharge lamp lighting apparatus comprising a discharge lamp having a pair of discharge electrodes within its tube and a sintered type oxide negative resistance starting element connected between said pair of discharge electrodes, said starting element comprising about 60 to 90 mol percent ZnO, 10 to 40 mol percent MgO, and 0.1 to 20 mol percent $MnO_2$.

5. A discharge lamp lighting apparatus according to claim 4 wherein said element comprises 70 to 74 mol% of ZnO, 16 to 20 mol% of MgO and 8 to 12 mol% of $MnO_2$.

* * * * *